US010401079B2

(12) United States Patent
Wing

(10) Patent No.: US 10,401,079 B2
(45) **Date of Patent: *Sep. 3, 2019**

(54) HANDLE ASSEMBLY FOR A REFRIGERATOR

(71) Applicant: Whirlpool Corporation, Benton Harbor, MI (US)

(72) Inventor: Forrest F. Wing, Victor, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/628,709

(22) Filed: Jun. 21, 2017

(65) Prior Publication Data

US 2017/0284728 A1 Oct. 5, 2017

Related U.S. Application Data

(63) Continuation of application No. 15/370,848, filed on Dec. 6, 2016, now Pat. No. 9,897,369, which is a (Continued)

(51) Int. Cl.
*E05B 1/00* (2006.01)
*F25D 23/02* (2006.01)
(Continued)

(52) U.S. Cl.
CPC ..... *F25D 23/028* (2013.01); *A47B 95/02* (2013.01); *E05B 1/0015* (2013.01); *F25D 11/02* (2013.01);
(Continued)

(58) Field of Classification Search
CPC ... Y10T 16/458; Y10T 16/498; Y10T 16/513; Y10T 16/24; Y10T 29/49826; Y10T 29/49876; Y10T 29/49947; Y10T 29/49948; Y10T 29/49963; Y10T 292/57; A47B 95/02; A47B 2095/023; E05B 1/00;
(Continued)

(56) References Cited

U.S. PATENT DOCUMENTS 2,234,097 A 3/1941 Tinnerman
2,345,371 A 3/1944 Amrine
(Continued)

FOREIGN PATENT DOCUMENTS

CN 201649801 U 11/2010
JP 9-67917 3/1997
(Continued)

OTHER PUBLICATIONS

GE Manual for Bottom Freezer Refrigerators (3828JL8012C).
(Continued)

*Primary Examiner* — Chuck Y Mah
(74) *Attorney, Agent, or Firm* — Nyemaster Goode, P.C.

(57) ABSTRACT

A handle assembly for mounting to a door of a refrigerator includes a main body member having first and second end portions separated by an intermediate portion. Each of the first and second end portions includes a cavity adapted to receive an end insert formed of soft material. Each of the end inserts includes an attachment member. The handle is mounted to a front face of the door through interengagment of the attachment members and base members provided on the door without scratching the surface of the door.

20 Claims, 7 Drawing Sheets

Related U.S. Application Data continuation of application No. 15/150,989, filed on May 10, 2016, now Pat. No. 9,709,318, which is a continuation of application No. 14/325,400, filed on Jul. 8, 2014, now Pat. No. 9,347,702, which is a continuation of application No. 13/597,776, filed on Aug. 29, 2012, now Pat. No. 8,776,320, which is a continuation of application No. 12/941,269, filed on Nov. 8, 2010, now Pat. No. 8,281,460, which is a continuation of application No. 12/212,673, filed on Sep. 18, 2008, now Pat. No. 7,849,563, which is a continuation of application No. 11/485,373, filed on Jul. 13, 2006, now Pat. No. 7,793,388.

(51) Int. Cl.
*A47B 95/02* (2006.01)
*F25D 11/02* (2006.01)

(52) U.S. Cl.
CPC ..... *E05Y 2600/46* (2013.01); *E05Y 2900/31* (2013.01); *Y10T 16/458* (2015.01); *Y10T 16/498* (2015.01); *Y10T 29/49826* (2015.01); *Y10T 29/49876* (2015.01); *Y10T 29/49947* (2015.01); *Y10T 29/49948* (2015.01); *Y10T 29/49963* (2015.01)

(58) Field of Classification Search
CPC ..... E05B 1/0015; E05B 1/0053; E05B 85/10; E05B 79/06; F25D 23/02; F25D 23/028; F25D 2400/06
See application file for complete search history.

(56) References Cited

U.S. PATENT DOCUMENTS

| | | | |
|---|---|---|---|
| 3,017,657 | A | 1/1962 | Mills |
| 3,426,385 | A | 2/1969 | Gutshall |
| 3,648,411 | A | 3/1972 | Saunders et al. |
| 3,766,598 | A | 10/1973 | Roberts |
| 3,995,349 | A | 12/1976 | Roberts et al. |
| 4,087,141 | A | 5/1978 | Roberts |
| 4,745,656 | A | 5/1988 | Revlett |
| 4,912,809 | A | 4/1990 | Scheuer |
| 5,144,718 | A | 9/1992 | Ozawa |
| 5,231,731 | A | 8/1993 | Jones, Jr. |
| 5,402,553 | A | 4/1995 | Goetz et al. |
| 5,493,756 | A | 2/1996 | Shanok et al. |
| 5,659,927 | A | 8/1997 | Shanok et al. |
| 5,740,587 | A | 4/1998 | Onai et al. |
| 5,797,164 | A | 8/1998 | Donaghy |
| 5,860,538 | A | 1/1999 | Duero et al. |
| 6,339,339 | B2 | 1/2002 | Maeda |
| 6,430,780 | B1 | 8/2002 | Kim et al. |
| 6,507,978 | B1 | 1/2003 | Root et al. |
| 6,609,274 | B2 | 8/2003 | Christensen et al. |
| 6,629,339 | B2 | 10/2003 | Pohl et al. |
| 6,871,385 | B2 | 3/2005 | Wing et al. |
| 6,959,480 | B2 | 11/2005 | Wing et al. |
| 6,966,101 | B2 | 11/2005 | Chiang |
| 6,971,385 | B1 | 12/2005 | Flora |
| 7,219,394 | B2 | 5/2007 | Wu |
| 7,549,713 | B2 | 6/2009 | Gose et al. |
| 7,685,675 | B2 | 3/2010 | Jung et al. |
| 2003/0029021 | A1 | 2/2003 | Wing et al. |
| 2003/0056334 | A1 | 3/2003 | Finkelstein |
| 2003/0079313 | A1 | 5/2003 | Pohl et al. |
| 2003/0093876 | A1 | 5/2003 | Jung et al. |
| 2003/0106185 | A1 | 6/2003 | Worrell |
| 2003/0145433 | A1 | 8/2003 | Mandel |
| 2004/0094560 | A1 | 5/2004 | Gose et al. |
| 2006/0032023 | A1 | 2/2006 | Moon |
| 2006/0200948 | A1 | 9/2006 | Steurer |
| 2008/0313853 | A1 | 12/2008 | Hale |

FOREIGN PATENT DOCUMENTS

| | | | |
|---|---|---|---|
| JP | 10103850 | A | 4/1998 |
| JP | 10169138 | A | 6/1998 |
| JP | 11237170 | A | 8/1999 |
| JP | 2001336872 | A | 12/2001 |
| KR | 2009051800 | A | 5/2009 |

OTHER PUBLICATIONS

GE Manual for Bottom Freezer Refrigerators (3828JL8069A).
GE Manual for Bottom Freezer Refrigerators (3828JL8069B).
Use & Care Guide for Kenmore Bottom Freezer Refrigerator Model Nos. 596.75522400,596.75523400, 596.75524400, 596.75529400, 596.75532400, 596.75533400, 596.75534400, 596.75539400.
Use & Care Guide for Kenmore Bottom Freezer Refrigerator Model Nos. 596.76502500, 596.76503500, 596.76504500, 596.76509500, 596.76512500, 596.76513500, 596.76514500, 596.76519500.
Use & Care Guide for Kenmore Bottom Freezer Refrigerator Model Nos. 596.76522500, 596.76523500, 596.76524500, 596.76529500, 596.76532500, 596.76533500, 596.76534500, 596.76539500.
Maytag Service Maunaul (16025629).
Kenmore Bottom Freezer Refrigerator Use & Care Guide (12828112).
Kenmore Bottom Freezer Refrigerator Use & Care Guide (12828130).
Kenmore Bottom Freezer Refrigerator Use & Care Guide (12828131).
GE Manual for Bottom Freezer Refrigerators (3828JL8069C).
Maytag Refrigerator Manual (12828121).

HANDLE ASSEMBLY FOR A REFRIGERATOR

CROSS-REFERENCE TO RELATED APPLICATIONS

The present application represents a continuation application of and claims priority to U.S. patent application Ser. No. 15/370,848, pending, which application is a continuation application of and claims priority to U.S. patent application Ser. No. 15/150,989 filed May 10, 2016, pending, which application is a continuation of and claims priority to U.S. patent application Ser. No. 14/325,400 filed Jul. 8, 2014, now U.S. Pat. No. 9,347,702, which application is a continuation application of and claims priority to U.S. patent application Ser. No. 13/597,776 filed Aug. 29, 2012, now U.S. Pat. No. 8,776,320, which application is a continuation application of and claims priority to U.S. patent application Ser. No. 12/941,269 filed Nov. 8, 2010, now U.S. Pat. No. 8,281,460, which application is a continuation application of and claims priority to U.S. patent application Ser. No. 12/212,673 filed Sep. 18, 2008, now U.S. Pat. No. 7,849,563, which application is a continuation of and claims priority to U.S. patent application Ser. No. 11/485,373 filed Jul. 13, 2006, now U.S. Pat. No. 7,793,388, the disclosures of which are hereby incorporated by reference in their entireties.

BACKGROUND OF THE DISCLOSURE

The present invention pertains to the art of domestic appliances and, more particularly, to a handle assembly mounting arrangement for an appliance.

Conventional handle arrangements for domestic appliances, such as refrigerators, are often formed from multiple pieces, including a handle frame and a handle piece having a gripping portion. Such a handle is typically mounted to a refrigerator cabinet utilizing screws which extend through the handle piece and frame, clamping the handle to a panel of the refrigerator cabinet. Once the handle is in place, a cover is inserted over each screw, with the cover either extending only over the screw or along substantially an entire length of the handle. In general, this handle mounting arrangement is rather difficult to assemble and, often times, results in witness lines that detract from an overall aesthetic appearance of the refrigerator.

There exist numerous other types of refrigerator handle arrangements in the art, such as gas assist handles employed in an attempt to simplify the construction and assembly of the handle. However, regardless of these known arrangements, there still exists a need in the art for an improved mounting arrangement for a refrigerator handle assembly. More specifically, there exists a need for a mounting arrangement that provides a secure attachment, is aesthetically appealing and easily assembled. In addition, there exists a need for a mounting arrangement that can be readily mounted without scratching or otherwise damaging an outer surface of the refrigerator during construction of the appliance.

SUMMARY OF THE DISCLOSURE

The present invention pertains to a mounting arrangement for a refrigerator handle assembly. In accordance with a preferred form of the invention, the handle assembly can be selectively mounted to either a front face portion or a side edge of a refrigerator. The handle assembly includes a main body member having first and second end portions separated by an intermediate portion. Each of the first and second end portions includes a corresponding cavity that is adapted to receive a respective end insert.

In accordance with one aspect of the invention, each end insert is provided with a recessed portion having a base for receiving an attachment member, such as a clip. In accordance with another aspect of the invention, each end insert includes a threaded opening that receives the attachment member or screw. In this embodiment, the screw acts upon a base member to retain and draw the handle assembly against the refrigerator door. Regardless of the design, the end insert is formed from a soft material that will not scratch the refrigerator door when the handle assembly is mounted to the refrigerator.

Additional objects, features and advantages of the present invention will be more readily apparent from the following detailed description of preferred embodiments when taken in conjunction with the drawings wherein like reference numerals refer to corresponding parts in the several views.

DETAILED DESCRIPTION OF THE EMBODIMENTS

Figure 1:
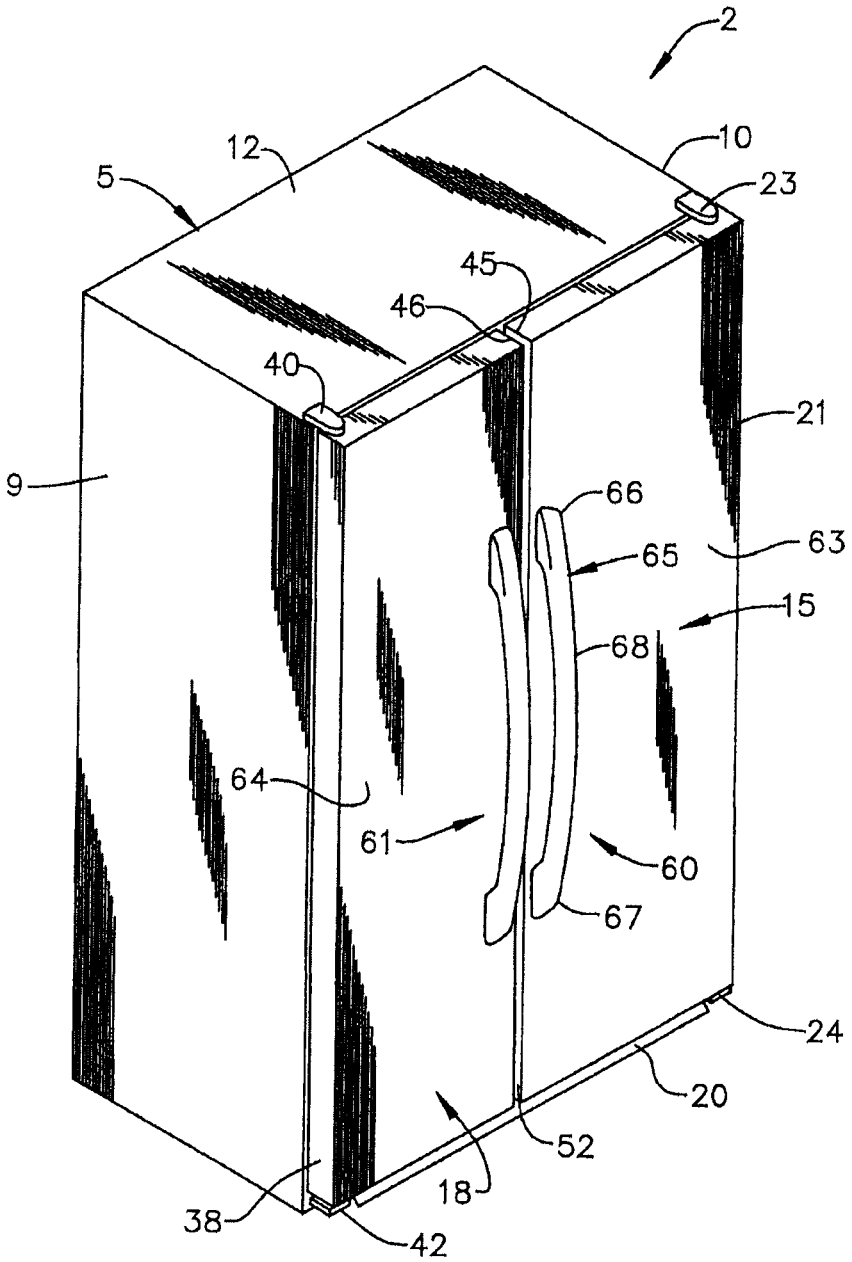
FIG. 1 is an upper left perspective view of a refrigerator incorporating a refrigerator door handle assembly mounted in accordance with the present invention.

With reference to FIG. 1, a domestic appliance constructed in accordance with the present invention is shown in the form of a refrigerator generally indicated at 2. As shown, refrigerator 2 includes a cabinet shell 5 having a pair of opposing side panels 9 and 10 which are interconnected by a top panel 12. Preferably, cabinet shell 5 is formed by bending a single sheet of metal in a manner known in the art. As illustrated, refrigerator 2 constitutes a side-by-side refrigerator having a fresh food compartment door 15 which is arranged laterally juxtaposed a freezer door 18. Extending laterally across cabinet shell 5, below fresh food and freezer doors 15 and 18, is a kick plate 20. In a manner known in the art, fresh food door 15 includes an outer vertical edge portion 21 which is pivotally attached to cabinet shell 5 through an upper hinge 23 and a lower hinge 24.

In a generally similar manner, freezer door 18 includes an outer edge portion 38 which is pivoted at an upper hinge 40 and a lower hinge 42 for movement relative to cabinet shell 5. In a manner also known in the art, fresh food door 15 and freezer door 18 have inner edge portions 45 and 46 respectively which are spaced by a vertical gap 52. As is also known, fresh food and freezer doors 15 and 18 conceal corresponding fresh food and freezer compartments (not shown). Aside from the aspects which will be described more fully below, the basic construction and operation of refrigerator 2 is known in the art and does not form part of the present invention. Therefore, this structure will not be discussed further herein. Instead, the present invention is directed to the design and mounting of handle assemblies 60 and 61 for fresh food and freezer doors 15 and 18 respectively.

In accordance with the invention, each handle assembly 60, 61 is mounted to a respective front face portion 63, 64 of fresh food and freezer doors 15 and 18. However, as each handle assembly 60, 61 is preferably identical, a detailed description will be made with respect to handle assembly 60 with an understanding that handle assembly 61 is correspondingly constructed. Handle assembly 60 is preferably made from hydroformed metal and includes a main body member 65 having a first end portion 66, a second end portion 67 and an intermediate portion 68. Handle assembly 60 can be mounted to door 15 through a pair of mounting arrangements, one of which is indicated at 70 in FIG. 2. Mounting arrangement 70 is preferably arranged at each of first and second end portions 66 and 67 in a manner that will be described more fully below.

Figure 2:
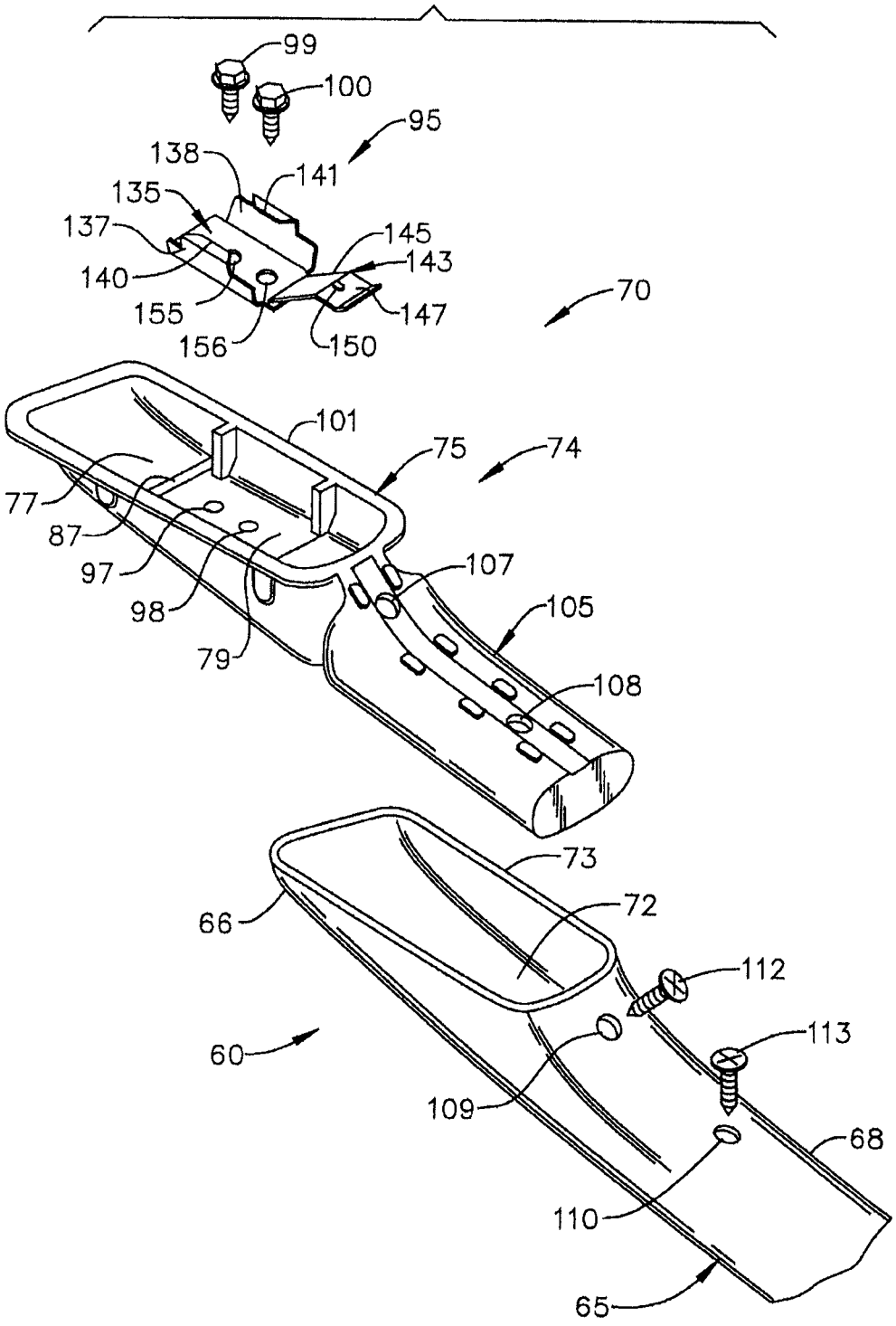
FIG. 2 is a partial exploded view of a handle assembly constructed in accordance with a first embodiment of the present invention.
Figure 3:
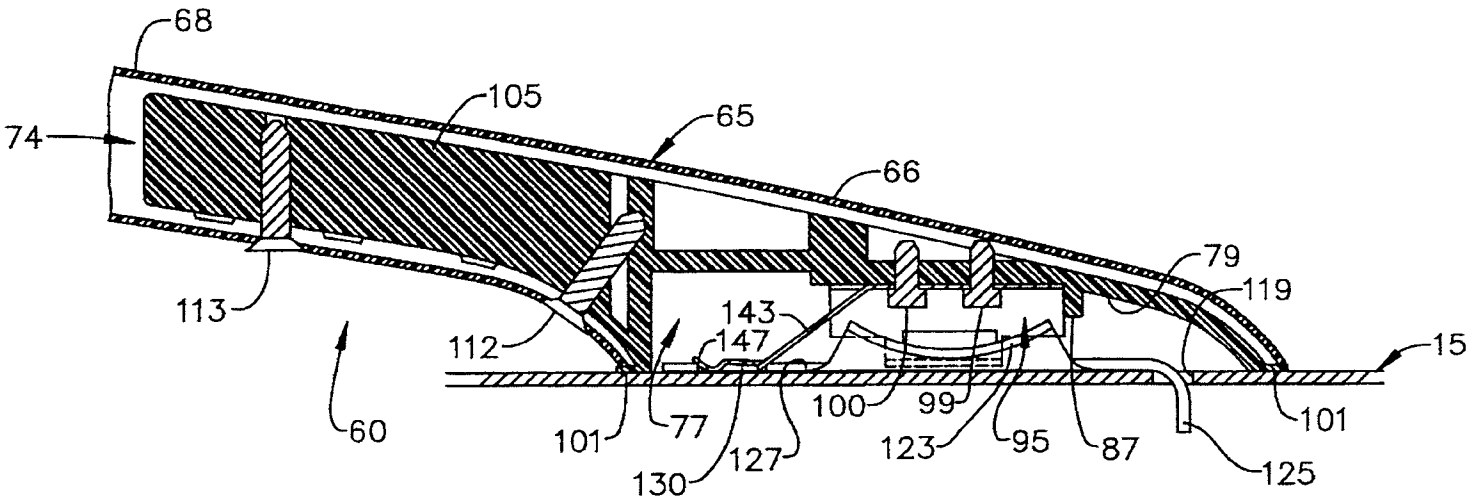
FIG. 3 is a partial, cross-sectional side view of the handle assembly of FIG. 2.
Figure 4:
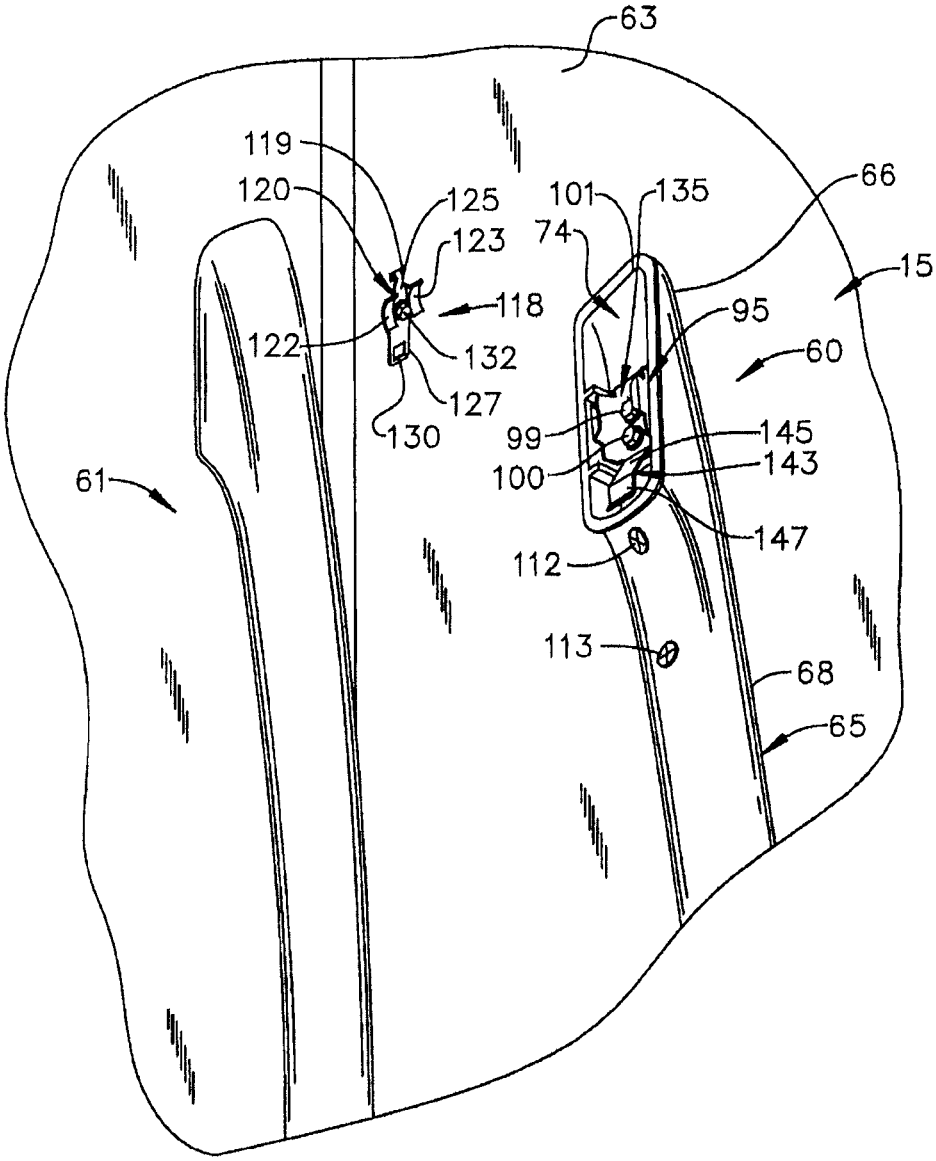
FIG. 4 is an exploded view of the refrigerator handle assembly of FIG. 2 illustrating attachment to a refrigerator door.

Reference will now be made to FIGS. 2-4 in describing mounting arrangement 70 constructed in accordance with a first embodiment of the present invention. However, at this point, it should be realized that, although reference will be made to only first end portion 66 of main body member 65, second end portion 67 includes identical structure so as to receive an identical mounting arrangement 70. In any event, first end portion 66 includes a cavity 72 for receiving a first portion of mounting arrangement 70. As shown, cavity 72 is circumscribed by a rim 73. That is, mounting arrangement 70 includes an end insert 74 which, in a manner that will be detailed more fully below, is positioned within cavity 72.

In accordance with the embodiment shown, end insert 74 is preferably formed from a soft, rubber-like, material and includes a main body portion 75 having a recessed portion 77. Recessed portion 77 preferably includes a base portion 79 provided with a ridge 87. Ridge 87 assists in positioning a handle clip portion 95 of mounting arrangement 70. Base portion 79 also includes a pair of apertures 97 and 98 that receive a corresponding pair of fasteners 99 and 100 for securing handle clip 95 to end insert 74. End insert 74 includes an outer, peripheral lip 101 that surrounds and extends outward from recessed portion 77. In this manner, once end insert 74 is positioned within cavity 72, lip 101 rests upon rim 73. In further accordance with the invention, end insert 74 also includes an elongated portion 105 that is provided with openings 107 and 108. Elongated portion 105 is sized so as to fit within a hollow interior portion of handle 60, with openings 107 and 108 aligning with corresponding openings 109 and 110 formed in main body member 65. Once properly aligned, screws 112 and 113 extend through respective ones of openings 109, 110 and engage with end insert 74 through openings 107 and 108.

As best shown in FIG. 4, handle assembly 60 is attached to front face portion 63 of fresh food door 15 through a base or door clip member 118. Door clip member 118 is preferably mounted to front face portion 63 of fresh food door 15 and cooperates with handle clip 95 which is secured within cavity 72. Towards that end, fresh food door 15 is provided with a hole (not shown) and a slot 119 that receive door clip member 118. Door clip 118 includes a main section 120 having a pair of spaced side connectors 122 and 123. As shown, each side connector 122, 123 is generally concave in shape so as to define an arcuate or convexly curved lower surface (not separately labeled). Door clip 118 also includes a tab member 125 that projects from one end (not separately labeled) of main section 120 and into slot 119. A leg extension 127 projects from an opposing end of main section 120. Leg extension 127 is provided with a through hole 130, which is generally rectangular or square in shape. A more detailed discussion of one form of door clip member 118 can be found in U.S. Pat. No. 7,549,713 filed Nov. 18, 2002 and entitled "Refrigerator Handle Mounting Arrangement" incorporated herein by reference.

Door clip member 118 is mounted to fresh food door 15 with tab member 125 projecting into slot 119 to provide proper alignment so that the central aperture of door clip member 118 is aligned with the hole (not shown) provided in fresh food door 15. Thereafter, a mechanical fastener 132, which is preferably a sheet metal screw, extends through the central aperture, into the hole and engages with fresh food door 15 to fixedly secure door clip member 118. At this point, it should be realized that the structure and mounting method of door clip member 118 can be readily varied without departing from the invention.

In further accordance with the invention, handle clip 95 includes a base portion 135 having upstanding side wall portions 137 and 138, each of which includes a corresponding in-turned flange member 140, 141. Each in-turned flange member 140, 141 projects laterally inward from a respective side wall portion 137, 138 respectively. In addition, base portion 135 is provided with a cantilevered arm 143. As shown, arm 143 includes a first angled section 145 extending from base portion 135. First angled section 145 leads to a catch section 147. More specifically, first angled section 145 projects from base portion 135 at an angle which forces catch section 147 to lie in a plane substantially parallel to flange members 140 and 141. First angled section 145 is actually lanced and bent to establish a clip member 150. Furthermore, base portion 135 is shown to include with a pair of spaced holes 155 and 156 that align with apertures 97 and 98 of end insert 74 as will be discussed more fully below.

Having described a preferred structure of mounting arrangement 70, reference will be made to FIGS. 2-4 in describing a preferred method of attaching handle assembly 60 to fresh food door 15. Initially, handle clip 95 is positioned over base portion 79 of end insert 74 such that holes 155 and 156 of handle clip 95 align with apertures 97 and 98. Fasteners 99 and 100 are employed to secure handle clip 95 within recessed portion 77. Apertures 97 and 98 could be provided with threads that engage fasteners 99 and 100. However, in order to simplify manufacturing, fasteners 99 and 100 are preferably self-tapping. Of course, it should be understood that various other joining methods could be employed, such as press-fit fasteners, rivets or the like. After securing mounting arrangement 70 in recessed portion 77, end insert 74 is positioned within cavity 72 of handle assembly 60 and secured with fasteners 112 and 113.

At this point, handle assembly 60 is ready to be mounted to fresh food door 15. To this end, first end portion 66 is initially aligned with door clip 118. Once so positioned, handle assembly 60 is then shifted or slid relative to fresh food door 15 such that door clip 118 and handle clip 95 interengage. More specifically, shifting handle 60 causes side connectors 122 and 123 of door clip 118 to engage with flange members 140 and 141 of handle clip 95. Moreover, as handle 60 is shifted, the curved lower surface (not labeled) of side connectors 122 and 123 create a wedging action between side connectors 122 and 123 and flange members 140 and 141, causing handle 60 to be progressively drawn against fresh food door 15. The shifting of handle 60 also results in leg extension 127 engaging arm 143. More specifically, the initial engagement causes arm 143 to deflect and, thereafter, snap back as clip member 150 enters into hole 130. Of course, a corresponding attachment simultaneously occurs at second end portion 67 of handle assembly 60. At this point, handle assembly 60 is fixed in position upon fresh food door 15.

Figure 5:
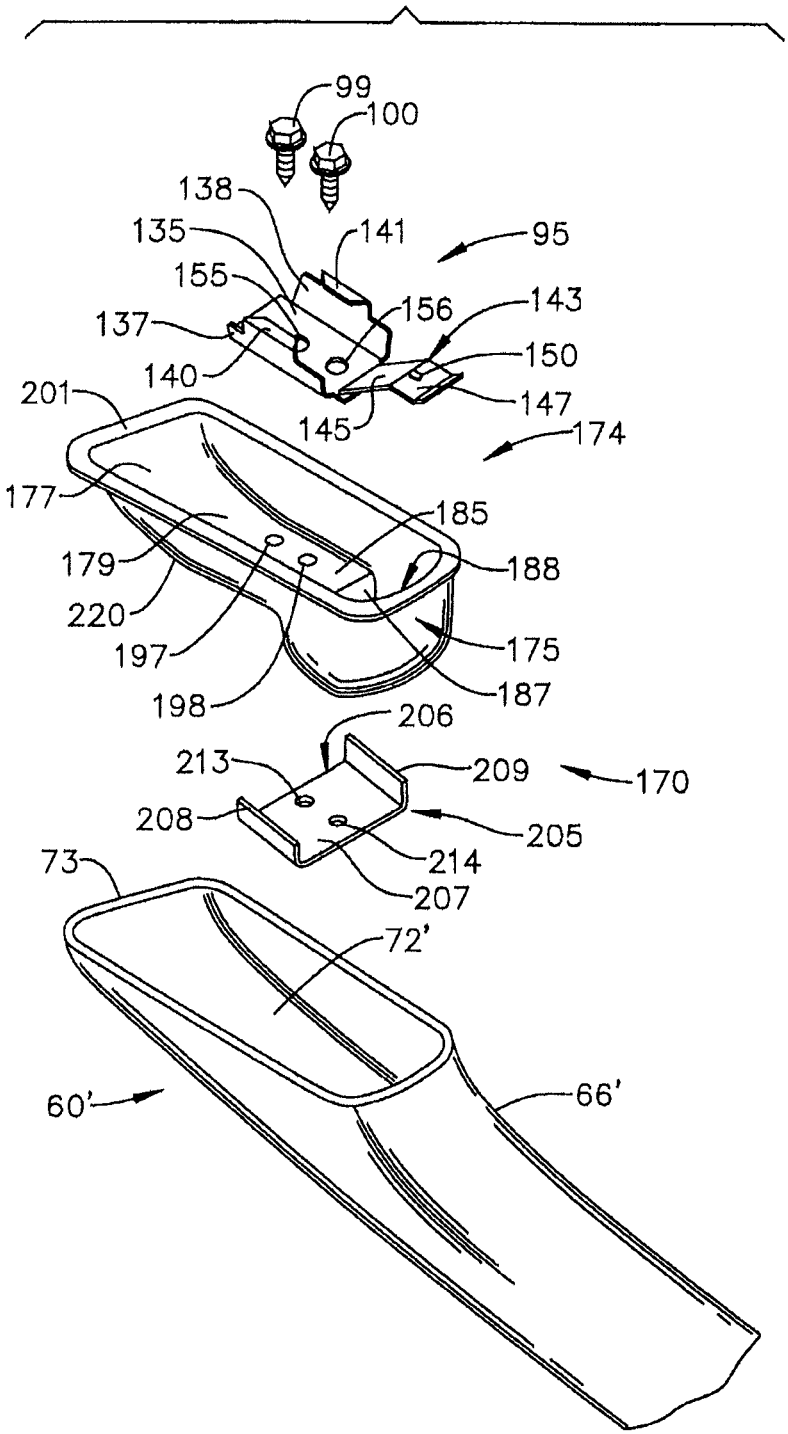
FIG. 5 is a partial exploded view of a refrigerator handle assembly constructed in accordance with a second embodiment of the present invention.
Figure 6:
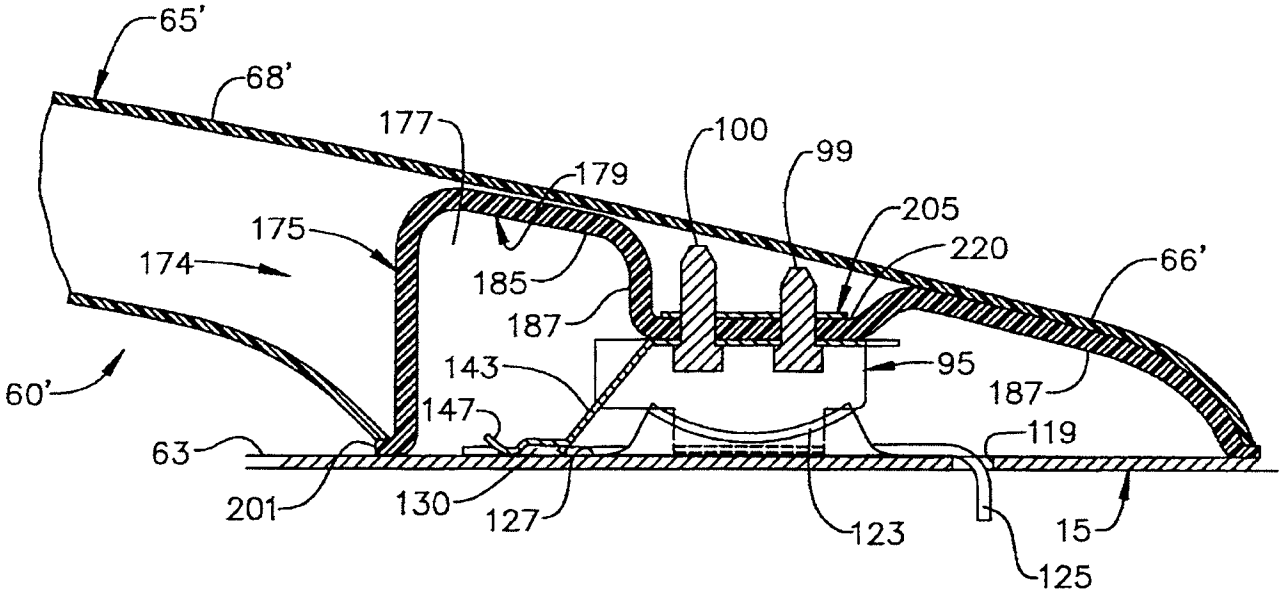
FIG. 6 is a partial cross-sectional side view of the refrigerator handle assembly of FIG. 5.

Reference will now be made to FIGS. 5 and 6 in describing a second embodiment of the invention. As shown, a mounting arrangement 170 for handle assembly 60' includes an end insert 174 having a main body portion 175 formed with a recessed portion 177. Recessed portion 177 includes a base 179 having a raised first end portion 185 that extends to sloping portion 187 before terminating at a second end portion 188. Raised portion 185 is provided with a pair of apertures 197 and 198. In a manner similar to that described above, end insert 174 includes a lip 201 that extends outward from main body portion 175 about recessed portion 177. In this manner, when end insert 174 is positioned within a cavity 72' formed in a first end portion 66' of a handle assembly 60', lip 201 rests upon a peripheral rim 73'. Mounting arrangement 170 further includes a bracket 205 having a main section 206 including a base section 207, as well as side walls 208 and 209 that extend substantially perpendicularly from base section 207. Base section 207 is also provided with a pair of apertures 213 and 214 which are sized to receive fasteners 99 and 100. Bracket 205 is preferably positioned against an underside 220 of insert 174, such that apertures 197 and 198 align with apertures 213 and 214 of bracket 205 in order to provide structure for engaging fasteners 99 and 100. Handle clip 95 is positioned within recessed portion 177 such that openings 155 and 156 align with apertures 197 and 198. Handle clip 95 is then secured to end insert 174 through fasteners 99 and 100. As set forth above, bracket 205 provides a metal fastening surface ensuring that handle clip 95 can be securely attached to end insert 174. In any event, end insert 174 is designed to be press-fit snugly within cavity 72' of end portion 66' and is retained therein through friction. Once end insert 174 and handle clip 95 are seated within cavity 72', handle assembly 60' is secured to refrigerator door 15 in a manner similar to that described above.

Figure 7:
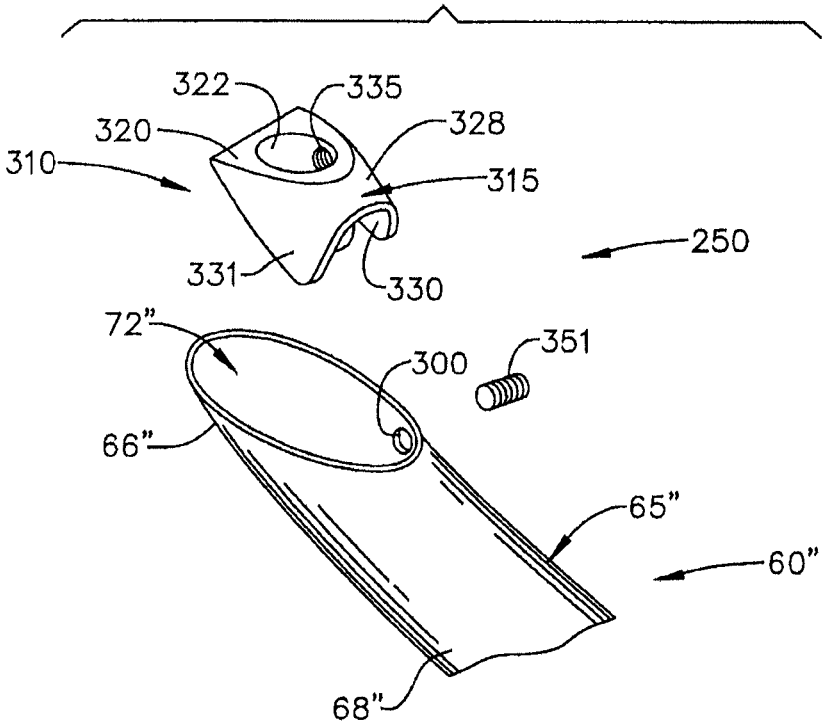
FIG. 7 is a partial exploded view of a handle assembly constructed in accordance with a third embodiment of the present invention.
Figure 8:
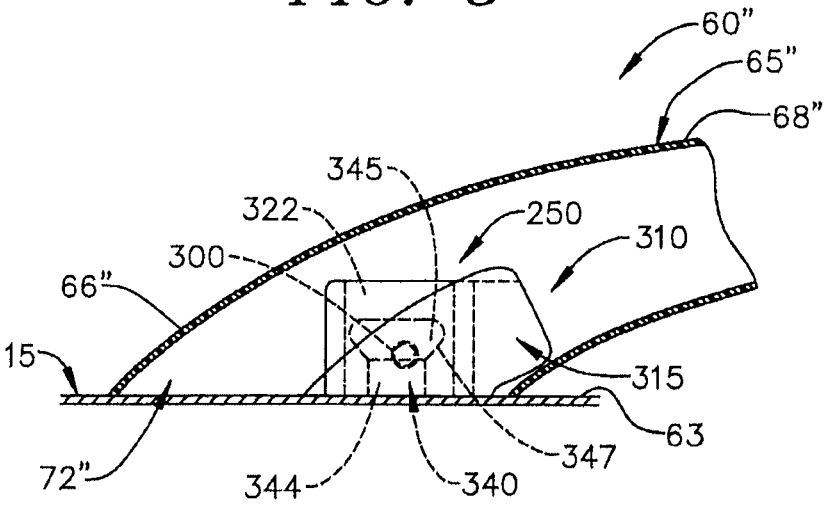
FIG. 8 is a partial, cross-sectional side view of the handle assembly of FIG. 7.

Reference will now be made to FIGS. 7 and 8 in describing a mounting arrangement 250 for securing a handle assembly 60" to fresh food door 15 constructed in accordance with a third embodiment of the invention. In a manner similar to that described above, handle assembly 60" is preferably hydroformed metal and includes a main body portion 65" having a first end 66", an intermediate portion 68" and a second end (not shown). First end 66" includes a cavity 72" and an access hole or opening 300. In a manner also similar to that described above, it should be realized that, although reference will be made to only first end 66", the second end (not shown) of handle assembly 60" includes identical structure.

In accordance with the embodiment shown, mounting arrangement 250 includes a first end insert 310 that includes a main body portion 315 preferably formed from ejection molded plastic. Main body portion 315 includes a first section 320 having defined therein a base member receiving portion 322, and a second section 328 formed with opposing side walls 330 and 331. In a manner that will be discussed more fully below, a threaded opening 335 is formed in side wall 330. Actually, threaded opening 335 can be formed in side wall 330 or, alternatively, be provided as a separate metal insert either molded or assembled into side wall 330. In any case, opening 335 leads to receiving portion 322.

Having described a preferred structure of mounting arrangement 250, reference will now be made to FIG. 8 in describing a preferred method of attaching handle assembly 60" to fresh food door 15. Initially, end insert 310 is positioned in cavity 72" of handle assembly 60" such that threaded opening 335 aligns with access hole 300. At this point, first end 65" is placed over a base member 340 that extends outward from front face portion 63 of fresh food door 15. Base member 340 preferably includes a lower stem section 344 that leads to an upper head section 345 which is provided with a tapered side area 347. Base member 340 is adapted to extend into base member receiving portion 322 of end insert 310 such that first section 320 lies flush against front face portion 63. At this point, an attachment member, preferably in the form of set screw 351, is inserted through access opening 312 and engaged into threaded opening 335. Attachment member 351 is tightened against upper tapered portion 347 of base member 340 causing main body portion 315 to be forced against an interior wall of first end 66". Continued tightening of attachment member 351 causes handle assembly 60" to be drawn against and seat firmly upon front face portion 63 of fresh food door 15. In a manner similar to that described in connection with the first and second embodiments, mounting arrangement 250 secures handle assembly 60" to fresh food door 15 without requiring threads to be formed in main body portion 65". That is, end insert 310 is only indirectly secured to handle assembly 60". With this arrangement, the present invention reduces the number and complexity of manufacturing steps in forming handle member 60".

Although described with reference to preferred embodiments of the invention, it should be understood that various changes and/or modifications can be made without departing from the spirit of the invention. For instance, although described with reference to a side-by-side refrigerator, corresponding handle assemblies could be equally employed in top mount, bottom mount or French door style refrigerators. In any event, the invention is only intended to be limited in accordance with scope of the following claims.

The invention claimed is:

1. A door comprising:

a door pivotally mounted relative to a cabinet, the door comprising a front face portion and a side edge;

a handle for opening the door relative to the cabinet, the handle including:

a main body having a first end and a second end joined by an intermediate portion;

a first end insert secured to the first end and a first metal insert coupled to first end insert, the first metal insert having a base member receiving portion positioned at the first end;

a first attachment member secured to the first end insert;

a second end insert secured to the second end and a second metal insert coupled to the second end insert, the second metal insert having a base member receiving portion positioned at the second end;

a second attachment member secured to the second end insert; and first and second base members disposed on the front face portion of the door, the first and second base members interengaging with respective ones of the first and second attachment members to secure the handle to the door.

2. The door of claim 1, wherein the main body further comprises first and second access holes corresponding to the first end and second end.

3. The door of claim 1, wherein the first and second end inserts comprise an internally threaded hole.

4. The door of claim 3, wherein the internally threaded holes are disposed in the first and second metal inserts.

5. The door of claim 3, wherein the first and second attachment members comprise set screws that threadably engage the internally threaded holes on the respective first and second end inserts.

6. The door of claim 5, wherein the internally threaded holes align with a first access hole at the first end and a second access hole at the second end.

7. An appliance door comprising:

a door mounted for movement relative to an appliance cabinet, the door comprising a front face portion and a side edge;

a handle for shifting the door relative to the cabinet, said handle comprising:

a main body member having first and second end portions joined by an intermediate portion, said first and second end portions having first and second cavities, along with first and second access holes extending through the main body member and opening into the first and second cavities, respectively;

a first end insert positioned in the first cavity of the main body member, the first end insert comprising a first metal ring having a side wall provided with a first opening aligned with the first access hole;

a first attachment member extending through the first access hole of the first end portion and the first opening, wherein the first attachment member is exposed to the first cavity;

a second end insert positioned in the second cavity of the main body member, said second end insert comprising a second metal ring having a side wall provided with a second opening aligned with the second access hole;

a second attachment member extending through the second access hole of the second end portion and the second opening, wherein the second attachment member is exposed to the second cavity;

first and second base members securely disposed on the front face portion of the door, said first and second base members projecting into the first and second cavities respectively, while being engaged by the first and second attachment members to secure the handle to the door.

8. The appliance door of claim 7, wherein each of the first and second openings in the first and second metal rings are internally threaded and threadably receive a respective one of the first and second attachment members.

9. The appliance door of claim 8, wherein each of the first and second attachment members directly abuts a respective one of the first and second base members.

10. The appliance door of claim 8, wherein each of the first and second base members includes a lower stem section projecting from the front face portion of the door and an upper head section, each of the first and second base members abutting a respective said upper head section.

11. The appliance door of claim 10, wherein the upper head section includes a tapered side, each of the first and second attachment members abutting a respective tapered side.

12. The appliance door of claim 10, wherein the first and second end portions are forcibly drawn against the front face portion of the door through the interaction of the first and second attachment members and tapering sides of the first and second base members.

13. The appliance door of claim 7, wherein the first and second attachment members are set screws.

14. A handle for a door comprising:

a handle assembly comprising:

first and second end inserts, the first end insert comprising a first attachment ring and the second end insert comprising a second attachment ring;

a main body member including first and second end portions interconnected by an intermediate portion, first and second access holes in a wall of the main body member positioned respectively at the first and second end portions;

a first recess at the first end portion of the main body member, the first end insert being located in the first recess;

a second recess at the second end portion of the main body member, the second end insert being located in the second recess;

a first fastener inserted through the first access hole, engaging the first end insert and projecting into the first recess;

a second fastener inserted through the second access hole, engaging the second end insert and projecting into the second recess; and wherein the first and second end inserts are configured to accept a base member disposed on a door to secure the handle assembly to the door.

15. The handle of claim 14, wherein the first and second fasteners each comprise a set screw.

16. The handle of claim 14, wherein the first and second access holes are each positioned in a side wall of the main body member respectively at the first and second end portions of the main body member.

17. The handle of claim 14, wherein the first and second end portions are shaped to lie flush against the door.

18. The handle of claim 14, wherein the first and second fasteners engage first and second threaded holes disposed respectively in the first and second end inserts.

19. The handle of claim 18, wherein the first and second threaded holes are disposed in respective ones of the first and second attachment rings.

20. The handle of claim 14, wherein the handle is disposed on a refrigerator.

* * * * *